US008042294B2

(12) United States Patent
Snider et al.

(10) Patent No.: US 8,042,294 B2
(45) Date of Patent: Oct. 25, 2011

(54) ORNAMENTAL ALBUM FRAME

(75) Inventors: Todd Snider, Palm Springs, CA (US); Felipe Nepomuceno, Palm Springs, CA (US)

(73) Assignee: Todd Snider, Palm Springs, CA (US)

( * ) Notice: Subject to any disclaimer, the term of this patent is extended or adjusted under 35 U.S.C. 154(b) by 287 days.

(21) Appl. No.: 11/938,718

(22) Filed: Nov. 12, 2007

(65) Prior Publication Data

US 2009/0119964 A1 May 14, 2009

(51) Int. Cl.
*A47G 1/06* (2006.01)

(52) U.S. Cl. ..... 40/800; 40/711

(58) Field of Classification Search ..... 40/709, 40/711, 722, 726, 729, 800, 490, 611.06; 206/39.5, 39.6, 39

See application file for complete search history.

(56) References Cited

U.S. PATENT DOCUMENTS

| | | | | |
|---|---|---|---|---|
| 1,068,621 | A | 7/1913 | Abraham | |
| 1,626,150 | A | 4/1927 | Parda | |
| 2,234,427 | A * | 3/1941 | Cox | 40/710 |
| 2,737,745 | A | 3/1956 | Hartmann | |
| 3,589,049 | A | 6/1971 | Cornelious | |
| 3,599,361 | A | 8/1971 | Bowman et al. | |
| 3,616,558 | A * | 11/1971 | Jahn | 40/711 |
| 3,680,239 | A | 8/1972 | Andrews | |
| 4,250,641 | A * | 2/1981 | Thompson | 40/705 |
| 4,691,456 | A | 9/1987 | Ackeret | |
| 4,932,529 | A | 6/1990 | Levine | |
| D311,219 | S | 10/1990 | Bergh | |
| 5,005,869 | A | 4/1991 | Smith | |
| 5,095,641 | A | 3/1992 | Dahl | |
| D335,304 | S | 5/1993 | Gordon | |
| 5,283,967 | A | 2/1994 | Abrams | |
| 5,454,179 | A * | 10/1995 | Bulka | 40/745 |
| 5,605,354 | A | 2/1997 | Kwon | |
| 6,003,901 | A | 12/1999 | Takemura | |
| 6,349,494 | B1 | 2/2002 | Haggarty-Robbins | |
| 6,357,843 | B1 | 3/2002 | Keller | |
| D468,350 | S | 1/2003 | Sussman et al. | |
| 6,845,582 | B1 | 1/2005 | Ho et al. | |
| 6,865,836 | B2 * | 3/2005 | Sachs-Lavery | 40/741 |
| 7,266,920 | B2 * | 9/2007 | Kao | 40/800 |
| 2005/0001420 | A1 | 1/2005 | Gordon | |
| 2005/0028417 | A1 * | 2/2005 | Kim | 40/711 |
| 2007/0119732 | A1 * | 5/2007 | Simba | 206/308.1 |
| 2008/0110071 | A1 * | 5/2008 | Farnsworth et al. | 40/722 |

FOREIGN PATENT DOCUMENTS

| | | |
|---|---|---|
| JP | 2000-25362 | 1/2000 |
| JP | 2001-96946 | 4/2001 |
| WO | WO2004/100733 A1 | 11/2004 |

* cited by examiner

*Primary Examiner* — Joanne Silbermann
(74) *Attorney, Agent, or Firm* — Christie, Parker & Hale, LLP

(57) ABSTRACT

An album frame is provided having an outer frame. The outer frame has a back side and an outer periphery. A mounting plate is attached to the back side of the outer frame. A support shelf extends frontwardly from the mounting plate along a first portion of the inner periphery. The support shelf is adapted to support a binding of an album. In addition, the outer frame may have a recessed groove in a second portion of the inner periphery. The second portion is located opposite the first portion of the inner periphery. Furthermore, the outer frame may include a first guiding ramp on a third portion of the inner periphery and a second guiding ramp on a fourth portion of the inner periphery. The first guiding ramp and the second guiding ramp allows an edge of an album cover to be guided into the recessed groove.

21 Claims, 5 Drawing Sheets

Fig. 14
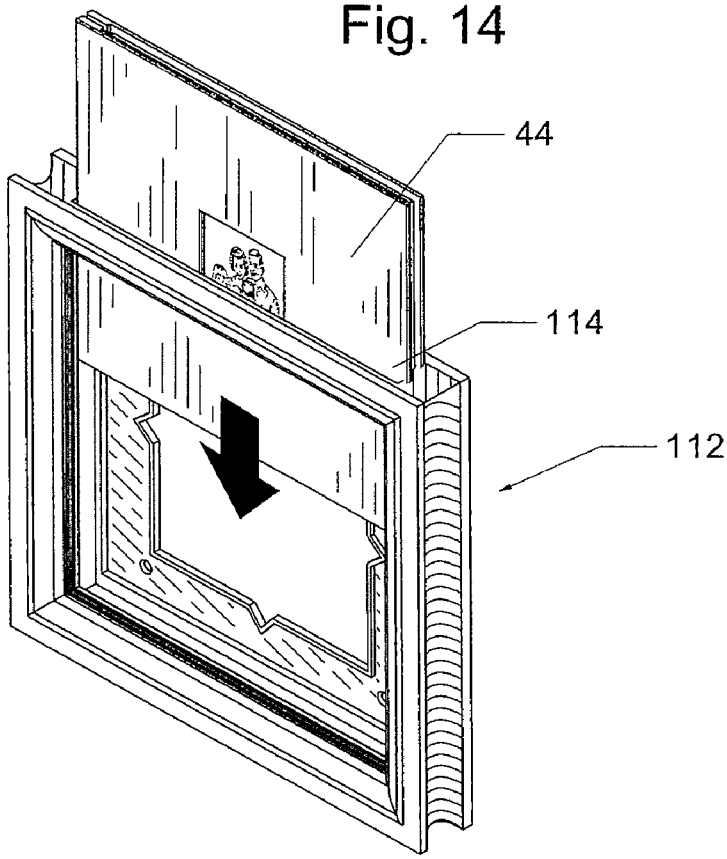
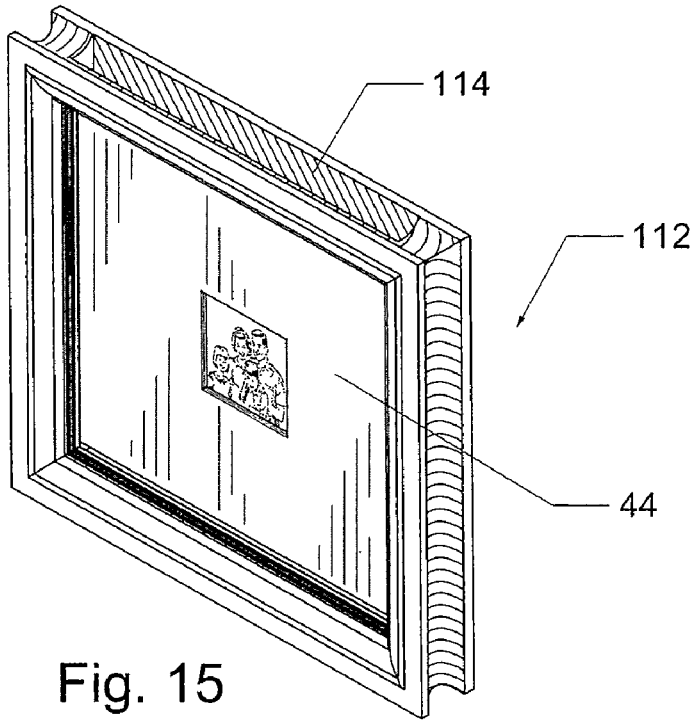
Fig. 15

ORNAMENTAL ALBUM FRAME

BACKGROUND OF THE INVENTION

1. Field of the Invention

The present invention relates to an ornamental album frame, and more particularly, to an ornamental album frame within which bound albums can be both stored and displayed.

2. Description of Related Art

People enjoy collecting, displaying, and viewing a variety of memorabilia and important records kept in bound albums such as photographs, pressed flowers, cards, and other sentimental items, as well as important documents such as diplomas, certificates, credentials, and the like.

SUMMARY OF THE INVENTION

In an exemplary embodiment, an ornamental bound album storage frame is provided that has no moving parts and is dimensionally compatible with a bound album that can be inserted into the frame such that the cover of the album, when seated within the frame, can resemble an image that has been matted and framed. A finger notch along one edge of the frame adjacent to the album's bound edge when seated in the frame can provide a means for conveniently removing the album from the frame. Guiding ramps along the top and bottom inside surfaces of the frame can engage the cover of the album when it is being inserted into the frame to lift and guide the unbound edge of the album cover into a groove that secures the cover in a flat position relative to the front of the frame. A shelf along one inside surface of the frame supports the bound edge of the album at a height that maintains the cover of the album in a flat position relative to the front of the frame. A magnet inlayed within the top surface of the shelf can engage a metal plate embedded within the back surface of the bound edge of an album to provide a means of further securing and holding the album within the frame. A mounting plate on the backside of the ornamental frame can incorporate a series of counter-bored holes that can receive screws capable of fastening the frame to a wall. A series of notches in the edges of an open portion of the mounting plate indicate the horizontal and vertical centerlines of the ornamental bound album storage frame and can provide a convenient means of aligning the frame to a wall or aligning a series of the frames when using, for example, pencil or chalk lines as a reference.

An album frame is provided having an outer frame and a support shelf. The outer frame has a back side and an inner periphery. The support shelf extends frontwardly from the back side along a first portion of the inner periphery. The support shelf is adapted to support a binding of an album in order to maintain the album cover in registration with a front portion of the album frame.

In an exemplary embodiment of the present invention, the album frame further includes a mounting plate attached to the back side of the outer frame.

In an exemplary embodiment of the present invention, the mounting plate has a plurality of mounting holes for affixing the album frame to a surface.

In an exemplary embodiment of the present invention the outer frame has a recessed groove in a second portion of the inner periphery. The second portion of the inner periphery is located opposite the first portion of the inner periphery.

In an exemplary embodiment of the present invention, the album frame further includes a first guiding ramp on a third portion of the inner periphery and a second guiding ramp on a fourth portion of the inner periphery. The first guiding ramp and the second guiding ramp guide an edge of an album cover into the recessed groove.

In an exemplary embodiment of the present invention, the album frame further includes a finger notch within the inner periphery for allowing easy removal of an album.

In an exemplary embodiment of the present invention, the album frame further includes fastening means on a top surface of the support shelf for fastening an album to the outer frame. The fastening means includes one or more of an adhesive, a hook and loop closure, a snap, a button, a clasp, or a magnet.

In an exemplary embodiment of the present invention, the fastening means is a magnet inlayed within the top surface of the support shelf.

In an exemplary embodiment of the present invention, the mounting plate has an inner opening and the inner opening has a plurality of centerline notches.

In an exemplary embodiment of the present invention, the album frame further includes muntins attached to the inner periphery for dividing the outer frame into subsections for storing a plurality of albums.

In an exemplary embodiment of the present invention, the mounting plate is a magnetic material.

In an exemplary embodiment of the present invention, the album frame further includes an easel flush with and pivotably coupled to a back of the mounting plate.

In an exemplary embodiment of the present invention, the outer frame includes a slot into which an album can be slidably inserted from an outer periphery of the outer frame through the inner periphery.

In another exemplary embodiment, an album frame is provided having an outer frame. The outer frame has a back side, an inner periphery, and a recessed groove in a first portion of the inner periphery. The album frame further includes a first guiding ramp on a second portion of the inner periphery and a second guiding ramp on a third portion of the inner periphery. The first guiding ramp and the second guiding ramp guide an edge of an album cover into the recessed groove. The album frame further includes a mounting plate attached to the back side of the outer frame.

In another exemplary embodiment, an album frame is provided having an outer frame. The outer frame has a back side, an inner periphery, and a recessed groove. The inner periphery includes a top inner periphery, a right inner periphery, a bottom inner periphery, and a left inner periphery. The recessed groove is located within the right inner periphery. The album frame further includes a mounting plate attached to the back side of the outer frame and a support shelf extending frontwardly from the mounting plate along the left inner periphery. The support shelf is adapted to support a binding of an album. The album frame further includes a first guiding ramp on the bottom inner periphery and a second guiding ramp on the top inner periphery. The first guiding ramp and the second guiding ramp guide an edge of an album cover into the recessed groove. The album frame further includes a finger notch within the inner periphery for allowing easy removal of an album.

BRIEF DESCRIPTION OF THE DRAWINGS

FIG. 14 is a perspective view of an ornamental bound album storage frame with an outer frame, which includes a slot into which an album can be slidably inserted from an outer periphery of the outer frame through the inner periphery.

FIG. 15 is a perspective view of the ornamental bound album storage frame from FIG. 14 showing a bound album seated within the inner periphery of the frame.

DETAILED DESCRIPTION

Figure 1:
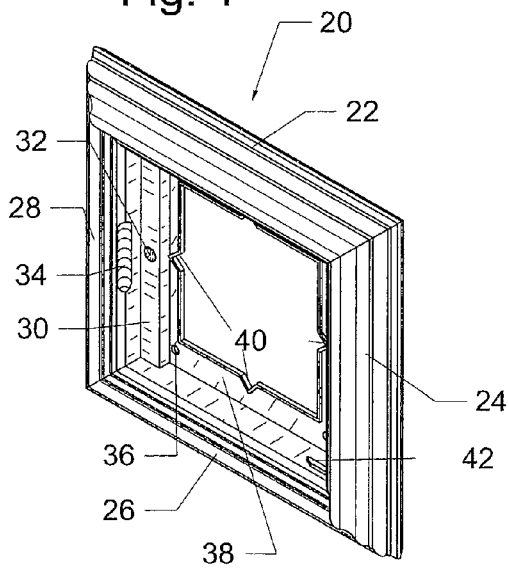
FIG. 1 is a perspective view of an ornamental bound album storage frame according to an exemplary embodiment of the invention.
Figure 2:
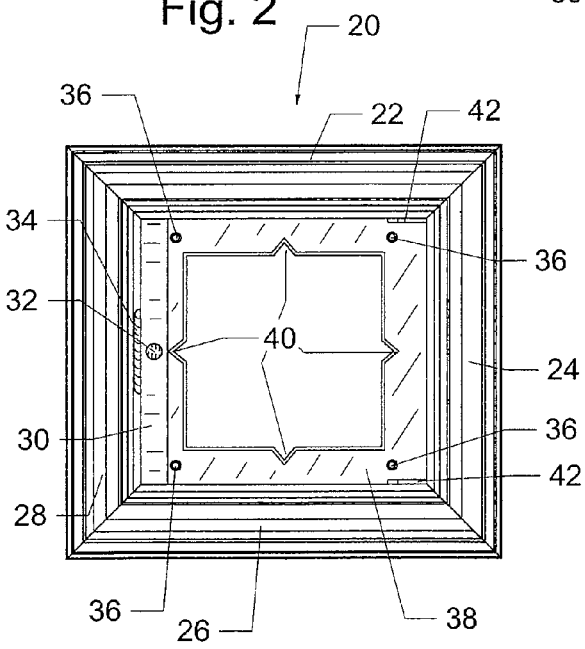
FIG. 2 is a front orthogonal view of the frame shown in FIG. 1.
Figure 3:
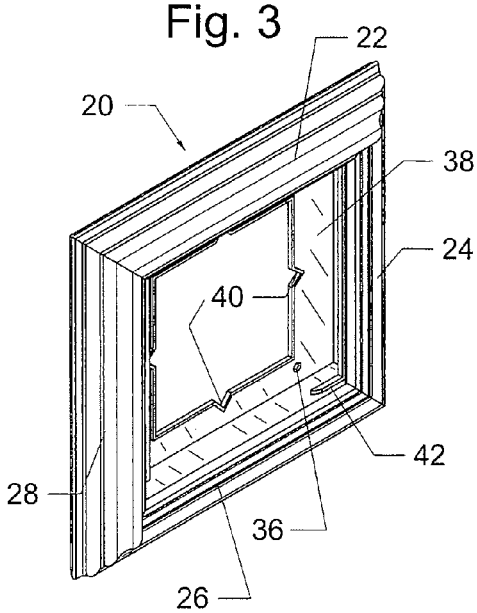
FIG. 3 is a perspective view of the frame shown in FIG. 1 from an alternate angle.

FIG. 1, FIG. 2, and FIG. 3 show an exemplary ornamental bound album storage frame 20. The frame 20 includes a rectangular frame having a horizontal frame member on the top 22, a vertical frame member on the right 24, a horizontal frame member on the bottom 26 and a vertical frame member on the left 28 joined together. Together, the frame members 22, 24, 26, and 28 may be called an outer frame. The frame 20 is designed to look like a conventional, familiar, attractive, quality picture frame.

A finger notch 34 is carved within the right front edge of the left frame member 28 and the notch 34 is vertically centered approximately at the midpoint between the top and bottom horizontal frame members 22, 26. The notch 34 can provide a means for conveniently removing an album from the frame 20 when the album is seated in the frame 20.

Guiding ramps 42 protrude from the top and bottom frame members 22, 26 on the inner peripheral surfaces perpendicular to the front surface (FIG. 2) of the frame 20. Greater detail regarding the ramps 42 is discussed in relation to FIG. 7A, FIG. 7B, and FIG. 8.

A binder support shelf 30 protrudes within the inner peripheral of the frame 20 from the bottom portion of the surface of the left frame member 28 that is perpendicular to the front surface (FIG. 2) of the frame 20.

Inlayed in the center of the front surface of the binder support shelf 30 is a magnet 32 (e.g., neodyminium-iron-boron (Nd—Fe—B), or the like). A mounting plate 38 substantially comprises the rear surface of the frame 20. Holes 36 located on the mounting plate 38 can be counter-bored and can receive appropriate fastening hardware such as nails or screws. Holes 36 provide a means of fastening the frame 20 to a wall using fastening hardware.

Centerline notches 40 located along the edges of the open portion of the mounting plate 38 provide a convenient means to assist in aligning and mounting the frame 20 to a wall as well as providing a convenient means to align and mount multiple ornamental bound album storage frames 20 when using, for example, pencil or chalk lines as a reference.

Figure 4:
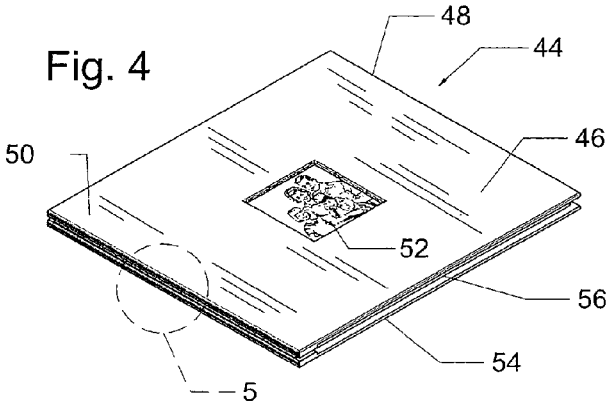
FIG. 4 is a perspective view of a typically bound album.

As depicted in FIG. 4, a typically bound album 44 has a front cover 46 with an unbound edge 48 on the opposite side of the bound side 50 of album 44 and a back cover 54. Sandwiched between covers 46 and 54 are a plurality of sheets 56 designed to receive conventional contents (e.g., photographs, cards, certificates, or the like) using a variety of known means for adhesion. The album 44 can incorporate a window 52 in which to display a particularly appropriate item (e.g., a photograph that best represents the general content of the album).

Figure 5:
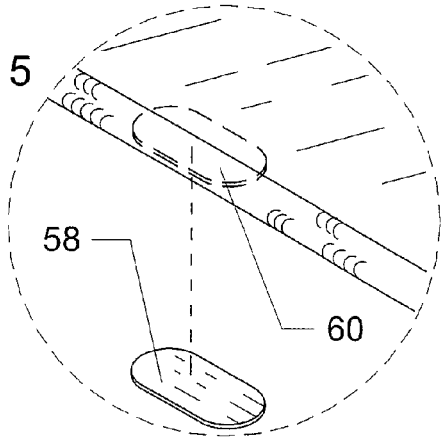
FIG. 5 is an enlarged perspective view of a portion of FIG. 4 with an exploded view of a metal plate embedded within a recess located on the back cover of the album from FIG. 4.

As depicted in FIG. 5, a metal plate or disk 58 can be respectively coupled, embedded, or otherwise attached to the rear surface of the back cover 54 within a recessed cavity 60. The disk 58 can be exposed or concealed behind material casing the back cover 54.

The metal disk 58 can be formed from magnetically permeable materials (e.g., iron, steel, or the like) thereby the magnet 32 on the binder support shelf 30 and the metal disk 58 embedded within the recess 60 at the rear surface of the back cover 54 of the album 44 can be magnetically attached to one another and thereby releasably engage the album 44 to the frame 20 when the album 44 is seated within the frame 20 (FIG. 6) to provide a means of further securing album 44 within frame 20.

Figure 6:
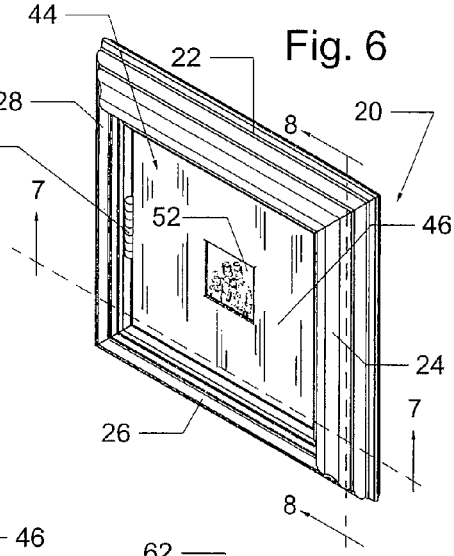
FIG. 6 is a perspective view of the album from FIG. 4 seated within the ornamental bound album storage frame from FIG. 1.

FIG. 6 best illustrates the function of the ornamental bound album storage frame 20 in conjunction with a typically bound album 44 of compatible dimensions, seated within the frame whereby the front cover 46 of album 44 with a window 52 displaying a photograph, resembles an image that has been matted and framed.

Figure 7A:
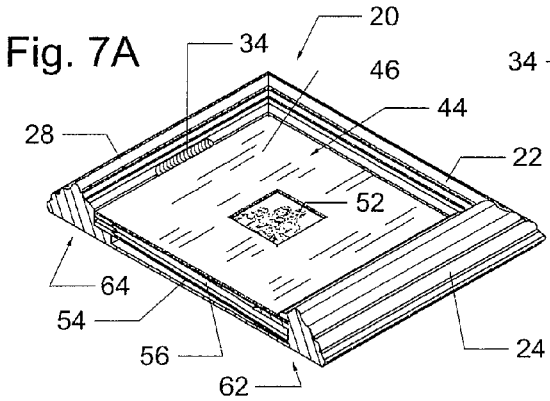
FIG. 7A is a perspective cross-sectional view taken along the plane of 7-7 in FIG. 6 showing a structural relationship between the album and the frame from FIG. 6 according to an exemplary embodiment of the invention.

FIG. 7A illustrates a structural relationship between the right edge 48 of the front cover 46 of the album 44 and the right supporting portion 62 of the ornamental bound album storage frame 20 as well as a structural relationship between the bound side 50 of the album 44 and the left supporting portion 64 of frame 20.

Figure 7B:
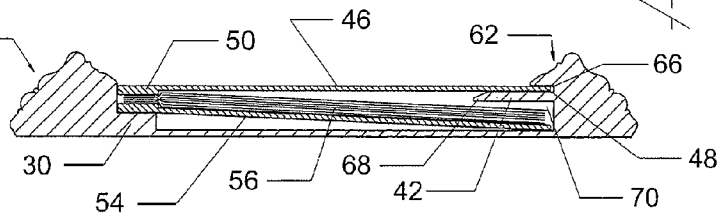
FIG. 7B is an orthogonal cross-section view taken along the plane of 7-7 in FIG. 6 illustrating a structural relationship between the album and the frame from FIG. 6 according to an exemplary embodiment of the invention.

The right supporting portion 62 in FIG. 7B, reveals the means for securing the right edge 48 of the front cover 46 of the album 44 within a recessed groove 66. Groove 66 secures the right edge 48 of the front cover 46 of the album 44 so cover 46 maintains a flat position relative to the front surface (FIG. 2) of the frame 20.

When the album 44 is being inserted into the frame 20, the guiding ramp 42 can engage the right edge 48 of the front cover 46 of the album 44 along the slanted surface 68 of the ramp 42. The guiding ramp 42 can then lift and guide right edge 48 into the recessed groove 66. The guiding ramp 42 also provides support to the rear surface of the front cover 46 of the album 44 to secure the cover 46 of the album 44 in a flat position relative to the front surface (FIG. 2) of the frame 20.

The back cover 54 of the album 44 along with the sheets 56 can reside beneath the front cover 46 within a cavity 70 that provides substantial space between the bottom surface of the front cover 46 of the album 44 and the top surface of the mounting plate 38 such that the space between sheets 56 can expand in anticipation of content applied to them such as photographs, scrapbook materials, memorabilia, important documents and other appropriate items conventionally stored within conventional bound albums.

The left supporting portion 64 in FIG. 7B best illustrates the means for supporting the bound side 50 of the album 44 on the binder support shelf 30. The shelf 30 supports the bound side 50 of the album 44 at a height that maintains the cover 46 of the album 44 in a flat position relative to the front surface (FIG. 2) of the frame 20.

Figure 8:
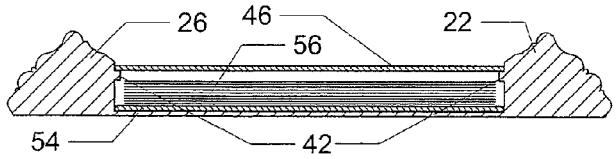
FIG. 8 is an orthogonal cross-section view taken along the plane of 8-8 in FIG. 6 showing a structural relationship between the album and the frame from FIG. 6 according to an exemplary embodiment of the invention.

As depicted in FIG. 8, the guiding ramps 42 protrude from the top 22 and bottom 26 frame members to a dimension wide enough to engage the album cover 46 but are not wide enough to come in contact with the album sheets 56.

Figure 9:
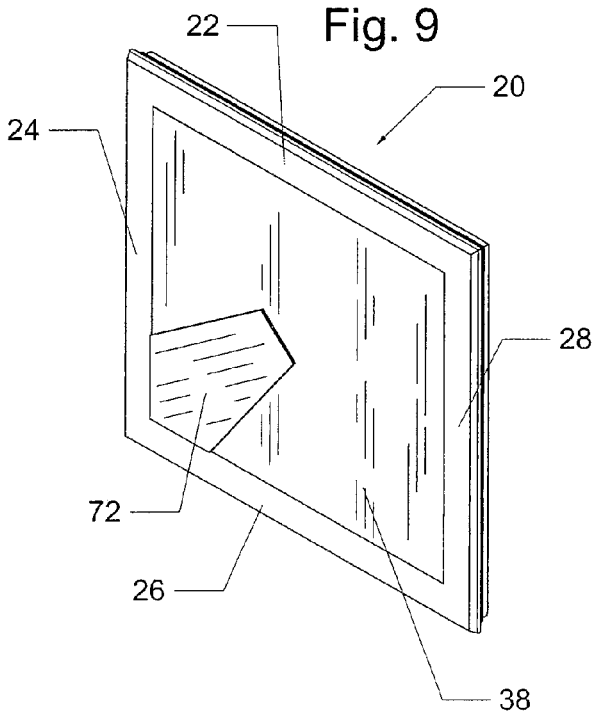
FIG. 9 is a perspective view of the back of the album frame from FIG. 1 showing an alternate embodiment of the mounting plate with an easel pivotably attached to the plate in a stowed position.
Figure 10:
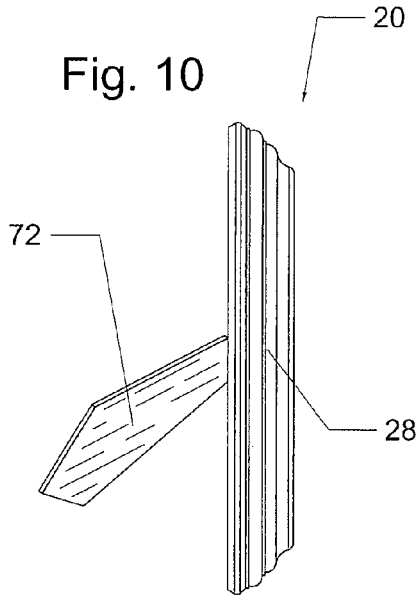
FIG. 10 is an orthogonal view of the back of the album frame from FIG. 1 showing an alternate exemplary embodiment of the mounting plate with an easel pivotably attached to the plate.
Figure 11:
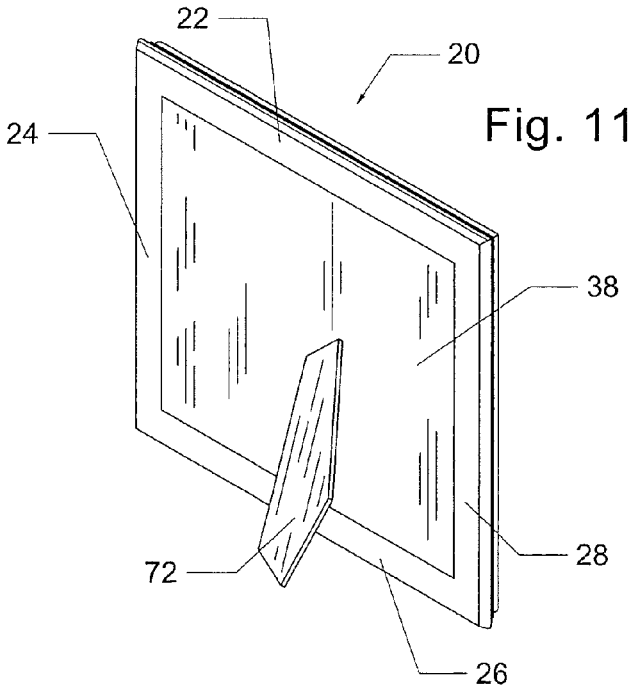
FIG. 11 is a perspective view from FIG. 10 of the frame with the mounting plate and the easel in a deployed position.

As shown in FIG. 9, FIG. 10, and FIG. 11, an easel 72 is pivotably coupled to the back of the mounting plate 38 in an alternate embodiment of mounting plate 38.

When in the open position (FIG. 10 and FIG. 11), the easel 72 extends from the back of the mounting plate 38 such that the frame 20 can be supported by the easel 72 on a generally horizontal surface (e.g., a tabletop, coffee tabletop, desktop, shelf, or the like). When in the closed position (FIG. 9), however, the easel 72 is substantially flush with the back surface of the mounting plate 38.

Figure 12:
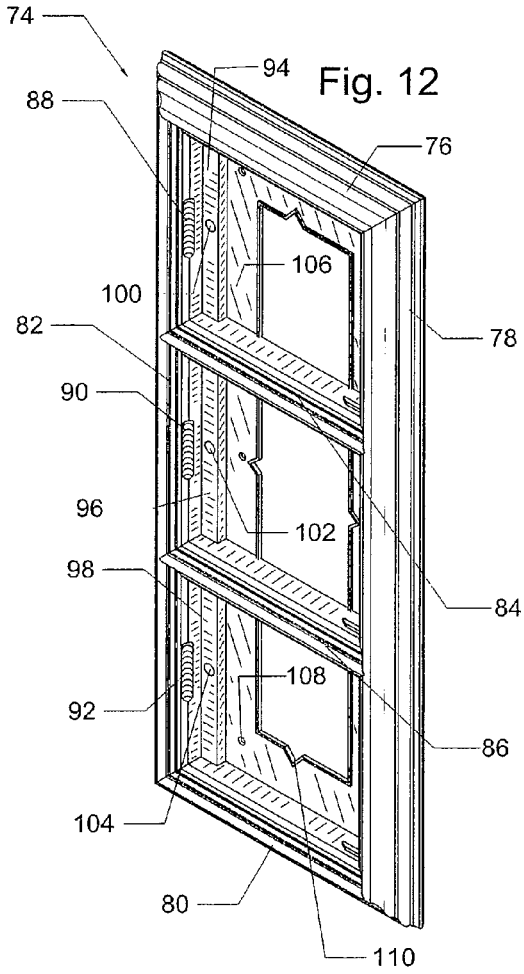
FIG. 12 is a perspective view of an ornamental storage frame for a plurality of bound albums according to an exemplary embodiment of the invention.

In another exemplary embodiment, an ornamental frame 74 (FIG. 12) has the capacity to hold multiple albums within the frame 74. The frame includes a rectangular frame having a horizontal frame member on the top 76, a vertical frame member on the right 78, a horizontal frame member on the bottom 80 and a vertical frame member on the left 82 joined together. An upper muntin 84 and a lower muntin 86 separate the frame into three bound album holders. The anatomy of each holder is similar to that of a single ornamental bound album storage frame 20. An upper finger notch 88 a middle finger notch 90 and a lower finger notch 92 provide a means for conveniently removing an album from the frame 74 when the album is seated in the frame 74. An upper binder support shelf 94 a middle binder support shelf 96 and a lower binder support shelf 98 protrudes within the inner peripheral of the frame 74 from the bottom portion of the surface of the left frame member 82 that is perpendicular to the front surface of the frame 74.

Inlayed in the center of the front surface of the upper binder support shelf 94 is a magnet 100 (e.g., neodyminium-iron-boron (Nd—Fe—B), or the like). In similar fashion, magnets 102 and 108 are inlayed in the middle and lower binder support shelves 96 and 98. A mounting plate 106 substantially comprises the rear surface of the frame 74. Holes 108 located on the mounting plate 106 can be counter-bored and can receive appropriate fastening hardware such as nails or screws. Holes 108 provide a means of fastening the frame 74 to a wall using fastening hardware.

Centerline notches 110 located along the edges of the open portion of the mounting plate 106 provide a convenient means to assist in aligning and mounting the frame 74 to a wall as well as providing a convenient means to align and mount multiple ornamental bound album storage frames 74 when using, for example, pencil or chalk lines as a reference.

Figure 13:
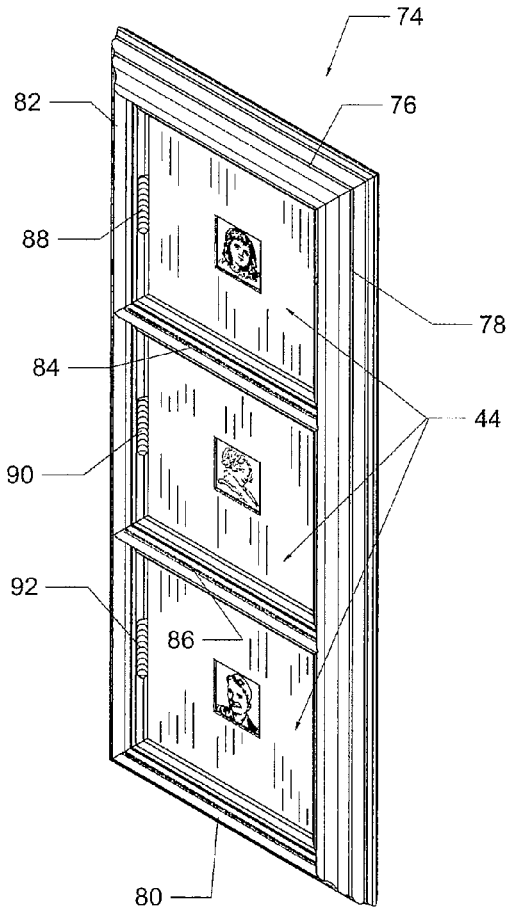
FIG. 13 is a perspective view of an ornamental storage frame for a plurality of bound albums with three typically bound albums seated within the frame.

As depicted in FIG. 13, three bound albums 44 can be seated within the frame 74.

The frame 74 is designed to look like a conventional, familiar, attractive, quality picture frame.

In yet another exemplary embodiment FIG. 14 and FIG. 15, the ornamental bound album storage frame 112 can be designed with at least one frame member having a slot 114 in which the album 44 can be slidably inserted within the frame from the outer peripheral of the frame.

A wide range of materials can be used for the frame including plastics, wood, metal, or the like, and frame 20, 74 or 112 can be monolithically formed from one such material or modularly assembled from components of the same material or varying materials based on the structural needs or cost benefits of the manufacturing process.

In an exemplary embodiment, the ornamental bound album storage frame 20 is rectangular. In other exemplary embodiments, other suitable shapes can be employed such as circular or square and the size of the frame 20 can vary substantially in correlation with the varying sizes of bound albums.

Alternate embodiments can employ other suitable fastening means to releasably engage the album 44 to the frame 20 such as adhesives, VELCRO® hook and loop closures, snaps, buttons, clasps, or the like. VELCRO® is a registered trademark of Velcro Industries B.V. In addition, the fastening means, including magnets, can be arranged in a variety of suitable configurations to achieve a similar function.

In another exemplary embodiment, a smaller frame 20 for a small album 44 can incorporate a mounting plate 38 that is substantially composed of magnetic material (e.g., neodyminium-iron-boron (Nd—Fe—B), or the like) of sufficient strength to allow the frame 20 to be magnetically attached to a magnetically permeable surface such as refrigerator door.

While the invention has been described in terms of exemplary embodiments, it is to be understood that the words, which have been used, are words of description and not of limitation. As is understood by persons of ordinary skill in the art, a variety of modifications can be made without departing from the scope of the invention defined by the following claims, which should be given their fullest, fair scope.

What is claimed is:

1. An album frame comprising:

an outer frame comprising a first frame member having a first inner periphery surface, a second frame member having a second inner periphery surface, a third frame member having a third inner periphery surface, and a fourth frame member having a fourth inner periphery surface, the outer frame having a back side, the outer frame having a recessed groove in the second inner periphery surface, the second inner periphery surface being located opposite the first inner periphery surface, the outer frame further comprising a first guiding ramp on the third inner periphery surface and a second guiding ramp on the fourth inner periphery surface, the first guiding ramp and the second guiding ramp for guiding an edge of an album cover into the recessed groove; and a support shelf extending frontwardly from the back side along the first inner periphery surface, the support shelf being adapted to support a binding of an album in order to maintain the album cover in registration with a front portion of the album frame.

2. The album frame as claimed in claim 1, further comprising a mounting plate attached to the back side of the outer frame.

3. The album frame as claimed in claim 2, wherein the mounting plate has a plurality of mounting holes for affixing the album frame to a surface.

4. The album frame as claimed in claim 2, wherein the mounting plate has an inner opening and the inner opening has a plurality of centerline notches.

5. The album frame as claimed in claim 2, wherein the mounting plate is a magnetic material.

6. The album frame as claimed in claim 2, further comprising:

an easel flush with and pivotably coupled to a back of the mounting plate.

7. The album frame as claimed in claim 1, further comprising:

a finger notch within one of the inner periphery surfaces for allowing easy removal of an album.

8. The album frame as claimed in claim 1, further comprising:

fastening means on a top surface of the support shelf for fastening an album to the outer frame, the fastening means including one or more of an adhesive, a hook and loop closure, a snap, a button, a clasp, or a magnet.

9. The album frame as claimed in claim 8, wherein the fastening means is a magnet inlayed within the top surface of the support shelf.

10. The album frame as claimed in claim 1, further comprising:

muntins attached to two parallel inner periphery surfaces for dividing the outer frame into subsections for storing a plurality of albums.

11. An album frame comprising:

an outer frame comprising a first frame member having a first inner periphery surface, a second frame member having a second inner periphery surface, a third frame member having a third inner periphery surface, and a fourth frame member having a fourth inner periphery surface, the outer frame having a back side and a mounting plate attached to the back side, a recessed groove in the first inner periphery surface, and a support shelf extending frontwardly from the mounting plate along the fourth inner periphery surface, the support shelf being adapted to support a binding of an album, the fourth inner periphery surface being located opposite the first inner periphery surface; and a first guiding ramp on the second inner periphery surface and a second guiding ramp on the third inner periphery surface, the first guiding ramp and the second guiding ramp for guiding an edge of an album cover into the recessed groove.

12. The album frame as claimed in claim 11, further comprising:

a finger notch within at least one of the inner periphery surfaces for allowing easy removal of an album.

13. The album frame as claimed in claim 11, further comprising:

fastening means on a top surface of the support shelf for fastening an album to the outer frame, the fastening means including one or more of an adhesive, a hook and loop closure, a snap, a button, a clasp, or a magnet.

14. An album frame comprising:

an outer frame comprising a first frame member having a top inner periphery surface, a second frame member having a right inner periphery surface, a third frame member having a bottom inner periphery surface, and a fourth frame member having a left inner periphery surface, the outer frame having a back side, and a recessed groove, the recessed groove being located within the right inner periphery surface;

a mounting plate attached to the back side of the outer frame;

a support shelf extending frontwardly from the mounting plate along the left inner periphery surface, the support shelf being adapted to support a binding of an album;

a first guiding ramp on the bottom inner periphery surface and a second guiding ramp on the top inner periphery surface, the first guiding ramp and the second guiding ramp for guiding an edge of an album cover into the recessed groove; and a finger notch within at least one of the inner periphery surfaces for allowing easy removal of an album.

15. The album frame as claimed in claim 14, wherein the mounting plate has an inner opening and the inner opening has a plurality of centerline notches.

16. The album frame as claimed in claim 14, wherein the mounting plate has an inner opening and the inner opening has a plurality of holes for fastening the mounting plate.

17. The album frame as claimed in claim 14, further comprising:

fastening means on a top surface of the support shelf for fastening an album to the outer frame, the fastening means including one or more of an adhesive, a hook and loop closure, a snap, a button, a clasp, or a magnet.

18. The album frame as claimed in claim 17, wherein the fastening means is a magnet inlayed within the top surface of the support shelf.

19. The album frame as claimed in claim 14, further comprising:

muntins attached to two parallel inner periphery surfaces for dividing the outer frame into subsections for storing a plurality of albums.

20. The album frame as claimed in claim 14, wherein the mounting plate is a magnetic material.

21. The album frame as claimed in claim 14, further comprising:

an easel flush with and pivotably coupled to a back of the mounting plate.

* * * * *